US007373882B2

(12) United States Patent
Heuschkel et al.

(10) Patent No.: US 7,373,882 B2
(45) Date of Patent: May 20, 2008

(54) METHOD FOR WASHING AN ANILOX INKING UNIT OF A PRINTING PRESS

(75) Inventors: Jörg Heuschkel, Viernheim (DE); Jens Hieronymus, Darmstadt (DE); Jürgen Michels, Dossenheim (DE); Dieter Schaffrath, Lorsch (DE); Wolfgang Schönberger, Schriesheim (DE); Bernhard Schwaab, Neustadt (DE); Michael Thielemann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 222 days.

(21) Appl. No.: 11/314,710

(22) Filed: Dec. 21, 2005

(65) Prior Publication Data

US 2006/0130680 A1 Jun. 22, 2006

(30) Foreign Application Priority Data

Dec. 21, 2004 (DE) ..... 10 2004 061 409

(51) Int. Cl.
*B41F 33/00* (2006.01)

(52) U.S. Cl. ..... 101/483; 101/424

(58) Field of Classification Search ..... None
See application file for complete search history.

(56) References Cited

U.S. PATENT DOCUMENTS 3,701,316 A * 10/1972 Sylvester et al. ..... 101/148
3,842,735 A * 10/1974 Southam et al. ..... 101/145
4,905,593 A * 3/1990 Gollinger et al. ..... 101/148
4,967,664 A 11/1990 Iijima ..... 101/423
5,174,209 A * 12/1992 Rodi et al. ..... 101/424
5,375,522 A 12/1994 Junghans ..... 101/424
5,911,175 A * 6/1999 Sondergeld et al. ..... 101/424
6,460,455 B1 * 10/2002 Eltner et al. ..... 101/148
6,895,861 B2 * 5/2005 Price et al. ..... 101/483
7,021,215 B2 * 4/2006 Schneider et al. ..... 101/487

FOREIGN PATENT DOCUMENTS

DE 36 06 007 10/1986
DE 10 2004005576 9/2004
EP 0839652 10/1996

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

In a method of washing an anilox inking unit of a press, a washing agent is introduced into the anilox inking unit. The washing agent is introduced into the anilox inking unit via a dampening unit or a part of the dampening unit.

4 Claims, 1 Drawing Sheet

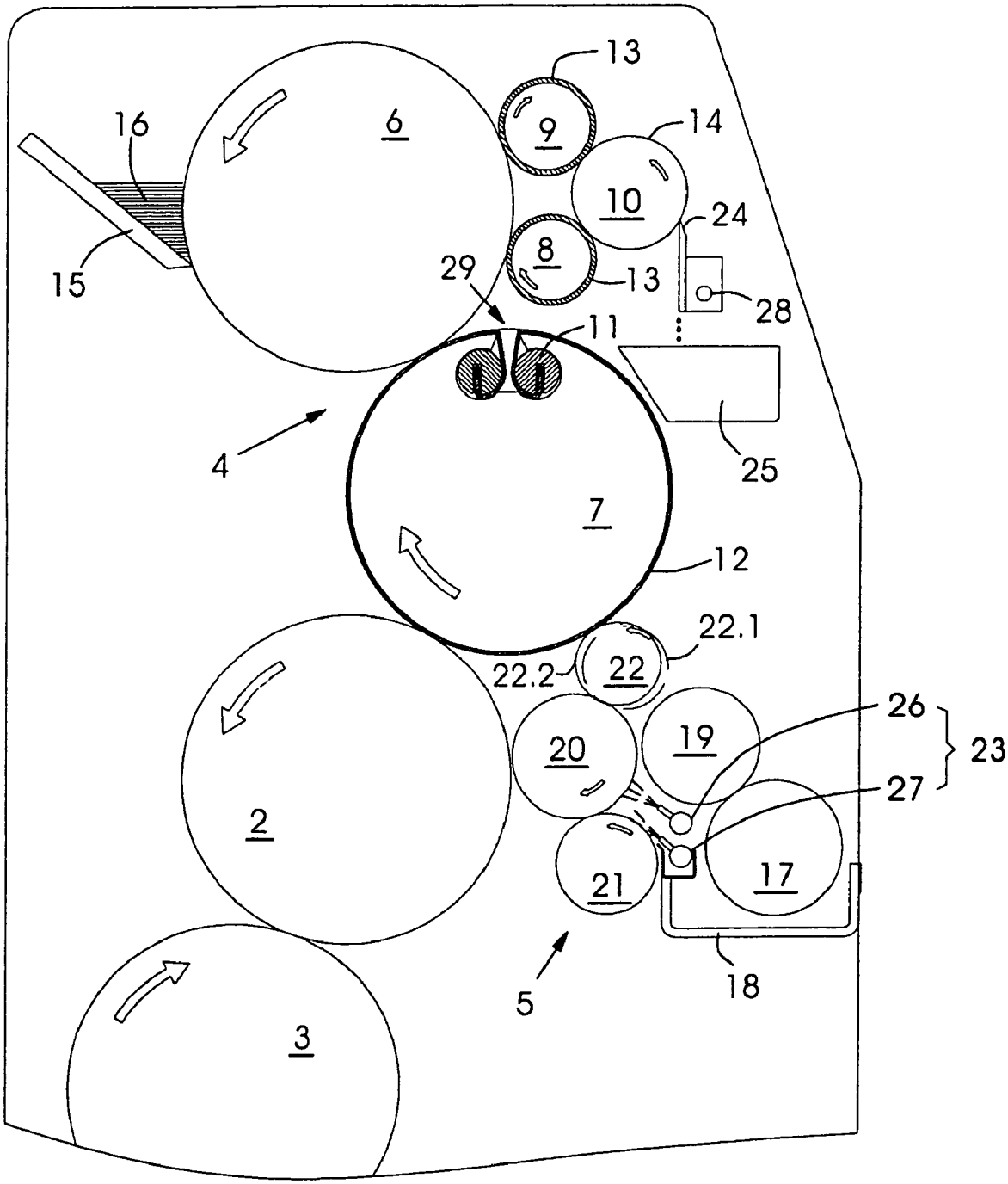
13
16
6
9
14
10
24
8
13
15
29
28
11
4
25
7
12
22.1
22.2
22
26
23
20
19
27
2
21
17
18
5
3

METHOD FOR WASHING AN ANILOX INKING UNIT OF A PRINTING PRESS

BACKGROUND OF THE INVENTION

1. Field of the Invention

The invention lies in the printing technology field. More specifically, the present invention relates to a method for washing an anilox inking unit of a press, wherein a washing agent is introduced into the anilox inking unit.

Commonly assigned, published German patent application DE 10 2004 005 576 A1 describes such a method. The distribution of the washing agent in the anilox inking unit during the washing process as described in the published patent application has some shortcomings.

2. Summary of the Invention

It is accordingly an object of the invention to provide a method of washing an anilox inking unit of the printing machine which overcomes the disadvantages of the prior art devices and methods of this general type and which ensures rapid distribution of the washing agent in the entire anilox inking unit.

With the foregoing and other objects in view there is provided, in accordance with the invention, a method for washing an anilox inking unit of a press. The method comprises the following steps:

introducing a washing agent into the anilox inking unit via a dampening unit of the press or part of the dampening unit; and washing the anilox inking unit.

In other words, the objects are achieved with the method in which the washing agent is introduced into the anilox inking unit via a dampening unit or a part of the dampening unit.

In accordance with one development, the washing agent is jetted or sprayed onto a dampening solution applicator roll and/or a dampening unit roll belonging to the dampening unit and resting only on the dampening solution applicator roll. The dampening unit roll can be a dampening solution distributor roll and rest on no roll other than the dampening solution applicator roll.

In a further development, the washing agent is conveyed out of the dampening unit into the anilox inking unit via a bridging roll. The bridging roll prescribes the direction from the dampening unit into the inking unit to the washing agent flow.

In a further development, the bridging roll rests on a dampening solution applicator roll and the bridging roll rests on an ink applicator roll only in a cleaning mode. In the printing operation mode, the bridging roll does not rest on the ink applicator roll.

In a further development, in the cleaning mode, the dampening solution applicator roll is thrown off a printing form cylinder of the press. However, in the printing operation mode, the dampening solution applicator roll is thrown onto the printing form cylinder.

In a further development, the washing agent is conveyed from the ink applicator roll via an screen roll, around at least a first inking unit roll resting on the screen roll, onto a further inking unit roll and doctored off the further inking unit roll. The further inking unit roll rests on the first inking unit roll.

The invention also includes a press which is designed to carry out the method according to the invention or a method corresponding to one of the developments.

Further constructionally and functionally advantageous developments emerge from the following description of a preferred exemplary embodiment and the associated drawing.

Other features which are considered as characteristic for the invention are set forth in the appended claims.

Although the invention is illustrated and described herein as embodied in a method for washing an anilox inking unit of a press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE is a partial side view of a printing unit which comprises an anilox inking unit and a dampening unit for wet offset printing.

DESCRIPTION OF THE PREFERRED EMBODIMENTS

Referring now to the sole FIGURE of the drawing in detail, there is shown a part of a press 1 for offset printing. The press 1 comprises a printing unit having a printing form cylinder 2, a blanket cylinder 3, an anilox inking unit 4, and a dampening unit 5. The anilox inking unit 4 comprises an screen roll 6 and an ink applicator roll 7, which have the same diameter as the printing form cylinder 2. In addition, the anilox inking unit 4 comprises a first roll 8, a second roll 9 and a third roll 10. The first roll 8 and the second roll 9 rest on the screen roll 6, and the third roll 10 rests on the first roll 8 and on the second roll 9.

The ink applicator roll has a clamping device 11 for clamping on a rubber blanket 12, which is seated in a cylinder channel 29 of the ink applicator roll 7.

The first roll 8 and the second roll 9 each have a resilient roll cover 13 and ensure ghosting-free printing. The resilient roll covers 13 are advantageous in a cleaning mode of the press 1, in that the roll covers 13 are temporarily pressed into the depressions (cells or grooves) of the engraved structure of the screen roll 6 and, when they are subsequently released from the screen structure, exert a suction effect, by means of which printing ink remaining in the depressions is conveyed out from the latter. In specific applications, there needs to be only one of the two rolls 8, 9 present.

The third roll 10 has a metallically hard circumferential surface, which is formed by a Rilsan® (polyamide) coating 14.

The third roll 10 is an axially oscillating ink distributor roll and is driven in rotation by a form fit, that is to say via a gear wheel firmly connected to the third roll 10 so as to rotate with it and arranged coaxially. In specific applications, the axial oscillating movement of the third roll 10 is not absolutely necessary.

Furthermore, the anilox inking unit 4 comprises an ink ductor 15, which bears on the screen roll 6 and holds a supply of is printing ink 16.

The dampening unit 5 comprises a dip roll 17 in a dampening solution fountain 18, a metering roll 19, a dampening solution applicator roll 20, and a dampening solution 20 distributor roll 21, which oscillates axially. The metering roll 19 rests on the dip roll 17 as a transfer roll and at the same time on the dampening solution applicator roll 20 when the press 1 is running in a printing operation mode (not illustrated in the drawing). In a cleaning mode, the metering 25 roll 19 is at least initially thrown off the dampening solution applicator roll 20, as shown. The dampening solution distributor roll 21 rests only on the dampening solution applicator roll 20 and, in specific applications, does not necessarily need to oscillate axially.

A bridging roll 22 is mounted such that it can be displaced as desired into a first position 22.1 and into a second position 22.2. In the first position 22.1, which is shown by a phantom line, the bridging roll 22 rests only on the dampening solution applicator roll 20 and the bridging roll 22 is thrown off from ink applicator roll 7. The bridging roll 22 assumes the first position 22.1 in the printing operation mode and assumes the second position 22.2 only in the cleaning mode. In the second position 22.2, which is shown by a solid line, the bridging roll 22 rests on the dampening solution applicator roll 20 and at the same time on the ink applicator roll 7. That is, in the cleaning mode, the dampening unit 5 is connected to the anilox inking unit 4 via the bridging roll 22, i.e., the dampening train is shorted into the ink train.

In the cleaning mode, a system comes into use which comprises a jetting or spraying device for introducing a washing agent into the dampening unit 5 and a cleaning blade or doctor blade 24 having a collecting trough 25 arranged underneath. The jetting or spraying device 23 comprises a washing agent spray pipe 26 and a water spray pipe 27, one spray pipe 26 or 27 being aimed at one of the two rolls 20, 21 in the region of an inlet pocket formed by the dampening solution applicator roll 20 together with the dampening solution distributor roll 21, and the other spray pipe being aimed at the other of the two rolls. The jetting or spraying device 23 therefore sprays the washing agent and the water into the inlet pocket or nip inlet. The cleaning doctor 24 is thrown onto the third roll 10 in the cleaning mode and is thrown off the latter in the printing operation mode. The cleaning doctor 24 is thrown on and off by being pivoted about a rotary joint 28.

During the cleaning of the anilox inking unit 4, the press 1 is operated as follows:

Firstly, the dampening solution applicator roll 20 is thrown off from the printing form cylinder 2 and the bridging roll 22 is thrown onto the ink applicator roll 7 (second position 22.2). In addition, the metering roll 19 is thrown off from the dampening solution applicator roll 20.

With the press 1 running the washing agent is then introduced, by way of the jetting or spraying device 23, into the inlet pocket between the dampening solution applicator roll 20 and the dampening solution distributor roll 21 at a number of spraying intervals. Particularly effective cleaning can be achieved in that, by way of the jetting or spraying device 23, the washing agent is sprayed or jetted alternately with water onto the rolls 20, 22 forming the inlet pocket. In specific applications, however, the water is not required, so that in these cases the water spray pipe 27 can be dispensed with.

Because the rolls run on one another, which is symbolized in the FIGURE by the arrows specifying the direction of rotation of the rolls, the washing agent is distributed in the entire anilox inking unit 4 and the washing agent is conveyed as far as the third roll 10. In the process, the washing agent flows over the bridging roll 22 onto the ink applicator roll 7, from the latter onto the screen roll 6 and from the latter over the first roll 8 and the second roll 9 onto the third roll 10.

As soon as the washing agent has arrived on the third roll 10 in a sufficient quantity, the cleaning doctor 14 is thrown onto the third roll 10 and the printing ink-washing agent mixture is doctored off the third roll 10. The printing ink-washing agent mixture doctored off is collected in the collecting trough 25. During the doctoring action, fresh washing agent is also sprayed into the dampening unit 5.

The operater of the press 1 can optionally set the program "clean printing form cylinder" on the latter, so that, within the above-described cleaning operation, the ink applicator roll 7 is thrown onto the printing form cylinder 2, as illustrated in the drawing. In this case, the ink applicator roll 7 rests on the screen roll 6 in the cleaning mode and, at the same time, on the printing form cylinder 2. In this way, the washing agent not only gets from the dampening solution applicator roll 20 over the bridging roll 22 onto the ink applicator roll 7 but also from the ink applicator roll 7 onto the printing form cylinder 2.

At the end of the cleaning process, first of all the supply of washing agent is stopped, somewhat later the cleaning doctor 24 is thrown off the third roll 10 and, after that, the metering roll 19 is thrown onto the dampening solution applicator roll 20 and the latter is thrown onto the printing form cylinder 2, in order to rinse the latter with the dampening solution from the dampening unit 5 before the start of the printing operation.

This application claims the priority, under 35 U.S.C. § 119, of German patent application No. 10 2004 061 409.1, filed Dec. 21, 2004; the disclosure of the prior application is herewith incorporated by reference in its entirety.

We claim:

1. A method for washing an anilox inking unit of a press, which comprises:

introducing a washing agent into the anilox inking unit via a dampening unit of the press or part of the dampening unit; and washing the anilox inking unit by:

jetting or spraying the washing agent onto at least one of a dampening solution applicator roll and a dampening unit roll belonging to the dampening unit and resting only on the dampening solution applicator roll;

conveying the washing agent out of the dampening unit into the anilox inking unit via a bridging roll, the bridging roll resting on the dampening solution applicator roll and resting on an ink applicator roll only in a cleaning mode of the press;

conveying the washing agent from the ink applicator roll via a screen roll and at least one first inking unit roll resting on the screen roll, onto a further inking unit roll, which rests on the at least one first inking unit roll, and doctoring the washing agent off the further inking unit roll.

2. The method according to claim 1, which comprises, in the cleaning mode, throwing off the dampening solution applicator roll from a printing form cylinder of the press.

3. A press configured to carry out the method according to claim 1.

4. In a printing press with an anilox inking unit, an improved system for washing the anilox inking unit, the improvement which comprises: a device configured to introduce a washing agent into the anilox inking unit via a dampening unit of the press or a part of the dampening unit and configured to carry out the method according to claim 1.

* * * * *